US007914668B2

(12) United States Patent
Siskin et al.

(10) Patent No.: US 7,914,668 B2
(45) Date of Patent: Mar. 29, 2011

(54) CONTINUOUS COKING PROCESS

(75) Inventors: Michael Siskin, Randolph, NJ (US); Christopher P. Eppig, Vienna, VA (US); Glen E. Phillips, Goldvein, VA (US); Te-Hung Chen, Vienna, VA (US); Charles J. Mart, Baton Rouge, LA (US)

(73) Assignee: ExxonMobil Research & Engineering Company, Annandale, NJ (US)

( * ) Notice: Subject to any disclaimer, the term of this patent is extended or adjusted under 35 U.S.C. 154(b) by 857 days.

(21) Appl. No.: 11/272,656

(22) Filed: Nov. 14, 2005

(65) Prior Publication Data

US 2007/0108036 A1 May 17, 2007

(51) Int. Cl.
*C10G 9/14* (2006.01)

(52) U.S. Cl. ..... 208/131

(58) Field of Classification Search ..... 208/131
See application file for complete search history.

(56) References Cited

U.S. PATENT DOCUMENTS

| | | | | |
|---|---|---|---|---|
| 2,702,269 | A * | 2/1955 | Geller | 208/132 |
| 2,985,585 | A * | 5/1961 | Scott, Jr. | 208/127 |
| 3,960,704 | A * | 6/1976 | Kegler et al. | 208/131 |
| 4,219,405 | A * | 8/1980 | Pietzka et al. | 208/131 |
| 4,257,778 | A * | 3/1981 | Murakami et al. | 208/131 |
| 5,128,026 | A * | 7/1992 | Newman et al. | 208/131 |
| 5,258,115 | A * | 11/1993 | Heck et al. | 208/131 |
| 7,247,220 | B2 * | 7/2007 | Malsbury | 202/242 |
| 7,425,259 | B2 * | 9/2008 | Stark et al. | 208/131 |
| 2004/0154913 | A1 | 8/2004 | Lah | |

FOREIGN PATENT DOCUMENTS

| | | | |
|---|---|---|---|
| WO | WO 9406888 | | 3/1994 |
| WO | WO 03042330 | | 5/2003 |
| WO | WO 03048271 | | 6/2003 |
| WO | WO 2004104139 | | 12/2004 |
| WO | WO 2004104139 | A1 * | 12/2004 |
| WO | WO 2005113706 | | 12/2005 |

OTHER PUBLICATIONS

D. G. Hammond et al., "Review of Fluid Bed Coking TEchnologoies", Petroleum Technology Quarterly, (Autumn 2003), pp. 1-6, XP-002419617.
PCT International Search Report, (2007).

* cited by examiner

*Primary Examiner* — Glenn Caldarola
*Assistant Examiner* — Randy Boyer
(74) *Attorney, Agent, or Firm* — Malcolm D. Keen; Glenn T. Barrett

(57) ABSTRACT

The invention relates to a thermal conversion process for continuously producing hydrocarbon vapor and continuously removing a free-flowing coke. The coke, such as a shot coke, can be withdrawn continuously via, e.g., a staged lock hopper system.

19 Claims, 6 Drawing Sheets

CONTINUOUS COKING PROCESS

FIELD OF THE INVENTION

The present invention relates to a method for producing and continuously removing coke from a coking drum. By making coke in the shot coke morphology where at least about 90 percent of the coke is free-flowing under the force of gravity or hydrostatic forces, coke can be continuously removed from a coker drum, such as a delayed coker drum. Removed coke can be quenched and conducted away from the process via a staged lock hopper system, for example.

BACKGROUND OF THE INVENTION

Delayed coking involves thermal decomposition of petroleum residua (resids) to produce gas, liquid streams of various boiling ranges, and coke. Delayed coking of resids from heavy and heavy sour (high sulfur) crude oils is carried out primarily as a means of disposing of these low value resids by converting part of the resids to more valuable liquid and gaseous products, and leaving a solid coke product residue. Although the resulting coke product is generally thought of as a low value by-product, it may have some value, depending on its grade, as a fuel (fuel grade coke), electrodes for aluminum manufacture (anode grade coke), etc.

In a conventional (i.e., known to those skilled in the art of hydrocarbon thermal conversion) delayed coking process, the feedstock is rapidly heated in a fired heater or tubular furnace. The heated feedstock is then passed to a large steel vessel, commonly known as a coking drum that is maintained at conditions under which coking occurs, generally at temperatures above about 400° C. under super-atmospheric pressures. The feed (e.g., a heavy hydrocarbon such as resid) in the coker drum generates volatile components that are removed overhead and passed to a fractionator, ultimately leaving coke behind. When the first coker drum is full of coke, the heated feed is switched to a "sister" drum and hydrocarbon vapors are purged from the drum with steam. The drum is then quenched by first flowing steam through the drum and then by filling the drum with water to lower the temperature to less than about 100° C. after which the water is drained. The draining is usually done back through the inlet line. When the cooling and draining steps are complete, the drum is opened (i.e., the top and bottom heads are removed from the drum) and the coke is removed by drilling and/or cutting using, e.g., high velocity water jets.

Following coke removal, the top and bottom heads are re-attached to the first drum, and the process is repeated. Coking occurs cyclically in the sister drum as in the first drum, but with the coking in the second drum generally operated out of phase with the coking in the first drum. In other words, while feed is conducted to the first drum, the second drum is undergoing purge, quench, head removal, coke removal, or head re-attachment and preparation for feed admission. A plurality of drums can be used each cycling through the steps of the delayed coking process. Delayed coking processes have a characteristic cycle time, which is the time from the start of feed admission to a drum in a cycle to the point at which feed is admitted to the drum in the immediately succeeding cycle. In other words, the cycle time includes the time taken to conduct feed to a drum, coke the feed, purge the drum, quench the coke, remove the top and bottom heads, remove the coke, reattach the heads, and prepare the drum for feed admission.

In order to open the drum for coke drilling, the top head of the coker drum is loosened and moved away from the top of the drum. Similarly, the bottom head of the vessel is loosened and moved away from the vessel so that coke can be conducted out of the vessel and away from the process. The moving and replacing the removable top head and bottom head of the vessel cover is called heading and unheading (or deheading). Unheading has several associated risk factors, many arising from the risk of personnel and equipment exposure to rapid drum depressurization, steam and hot water.

Quenching, unheading, coke drilling, and coke removal add considerably to the cycle time (and throughput) of the conventional process. Thus, it would be desirable to be able to produce a free-flowing coke, in a coker drum, that would not require the expense and time associated with conventional coke removal, particularly the need to drill-out the coke. It would also be desirable to be able to safely remove such substantially free-flowing coke from the drum, preferably in a continuous process.

SUMMARY OF THE INVENTION

In accordance with the present invention, there is provided a continuous coking process in a coking vessel, the process comprising:

a) conducting a hydrocarbon feed to a coker vessel under coking conditions;
b) maintaining the coker vessel coking conditions while continuing to add the feed for an effective amount of time in order to produce a hydrocarbon vapor and a substantially free-flowing shot coke;
c) conducting at least a portion of the hydrocarbon vapor out of the vessel and away from the process; and
d) continuously conducting the coke out of the vessel and away from the process.

In another embodiment, the process comprising:

a) conducting a heated residuum feedstock to a coker vessel under coking conditions, which feedstock is one that is capable of producing a free-flowing coke;
b) maintaining the coker vessel coking conditions while continuing to add the feedstock for an effective amount of time in order to produce a hydrocarbon vapor and a substantially free-flowing shot coke;
c) continuing to add feedstock until the combination of feedstock and coke has partially but not completely filled the vessel;
d) continuously conducting at least a portion of the hydrocarbon vapor out of the vessel and away from the process; and
e) continuously conducting the coke out of the vessel and away from the process.

In an embodiment, the amount of feedstock conducted to the vessel, the amount of hydrocarbon conducted away from the vessel, and the amount of coke conducted away from the coker vessel is regulated so that the amount of coke and feed in the vessel comprise between about 10% and 90% of the volume of the vessel.

In another embodiment, at least about 90 volume percent of the volume of the coke in the vessel is in the form of a substantially free-flowing coke.

In another embodiment, the process further comprises conducting the coke from the vessel to a container, such as a lock hopper, where the coke can be stripped, quenched, and conducted away from the process. A plurality of containers, comprising a system of lock hoppers, can be used in continuous operation. In a related embodiment, the coke removed from the vessel would be stripped of hydrocarbon vapor prior to the coke being conducted to the container(s). Conventional stripping technology can be employed. Stripped hydrocarbon can be separated from the stripping medium for one or more of (i) combining with the hydrocarbon vapor, (ii) combining with the feedstock, or (iii) conducting away from the process for storage or further processing.

DETAILED DESCRIPTION OF THE PREFERRED EMBODIMENTS

Figure 1:
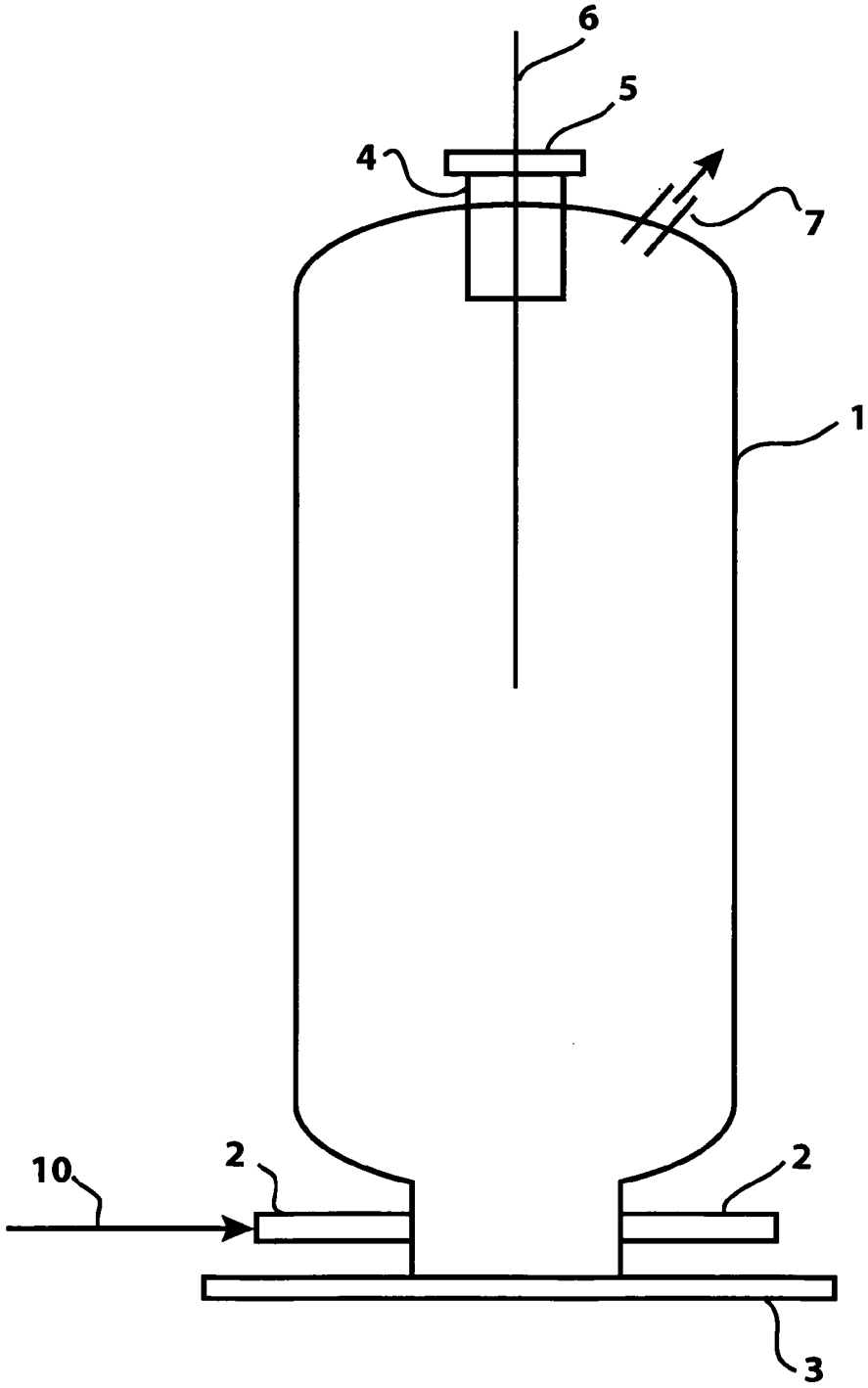
FIG. 1 is a schematic representation of a coker vessel of the present invention showing the position of the feed injection system and the systems for the removal of hydrocarbon vapor and coke.

In an embodiment, the invention relates to an improvement to a delayed coking process. In delayed coking, a heavy hydrocarbon feedstock, such as a resid, is heated to coking temperature and then conducted to a delayed coking vessel (usually called a "drum") where coking conditions are maintained for a time sufficient to form a hydrocarbon vapor product, and a solid coke in the drum. Vapor is removed from the drum and conducted away from the process. Following unheading, a drill is inserted through the top head to loosen the coke in the vessel for removal through the bottom head. Once the vessel is de-coked, the heads are closed and the process repeats. One or more adjacent vessels can be operated out of phase with the first vessel in order to approximate semi-continuous batch operation. In other words, adjacent coke drums are operated in a batch mode with drum pairs alternating the filling and decoking cycles.

In the instant process, one or more coker vessels (e.g., drums) can be operated continuously. Feedstock is heated and the coke drum is maintained under coking conditions of temperature and pressure, as in the conventional process, but the feedstock and coke in the vessel are maintained at an equilibrium level or elevation by regulating the rate of feedstock admission to the rate of coke removal.

Accordingly, the instant process, which can be a fully continuous process, is advantageous in that it provides for more stable operation, mitigation of risk factors, and higher yield of coke and hydrocarbon vapor. Higher yield is obtained by the substantial elimination of conventional drum capacity limitations compared to the standard delayed coker configuration. Continuously withdrawing a free-flowing loose coke or shot coke product also eliminates the need for conventional high pressure cutting water systems employed to remove the coke bed from the drums in conventional units. Maintenance of associated equipment such as jet pumps, derricks, hoists, rotary joints and cutting bits would be eliminated or dramatically reduced.

Petroleum residua ("resid") feedstocks are suitable for the continuous coking process. Such petroleum residua are frequently obtained after removal of distillates from crude feedstocks under vacuum and are characterized as being comprised of components of large molecular size and weight, generally containing: (a) asphaltenes and other high molecular weight aromatic structures that would inhibit the rate of hydrotreating/hydrocracking and cause catalyst deactivation; (b) metal contaminants occurring naturally in the crude or resulting from prior treatment of the crude, which contaminants would tend to deactivate hydrotreating/hydrocracking catalysts and interfere with catalyst regeneration; and (c) a relatively high content of sulfur and nitrogen compounds that give rise to objectionable quantities of $SO_2$, $SO_3$, and $NO_x$ upon combustion of the petroleum residuum. Nitrogen compounds present in the resid also have a tendency to deactivate catalytic cracking catalysts.

In an embodiment, the feedstocks include, but are not limited to, residues from the atmospheric and vacuum distillation of petroleum crudes or the atmospheric or vacuum distillation of heavy oils, visbroken resids, tars from deasphalting units or combinations of these materials. Atmospheric and vacuum-topped heavy bitumens, coal liquids and shale oils can also be employed. Typically, such feedstocks are high-boiling hydrocarbonaceous materials having a nominal initial boiling point of about 1000° F. (537.78° C.) or higher, an API gravity of about 20° or less, and a Conradson Carbon Residue content of about 0 to 40 weight percent. In an embodiment, the coker feedstock is blended so that the total dispersed metals of the blend will be greater than about 250 wppm and the API gravity is less than about 5.2. In a preferred embodiment, the coker feedstock is a vacuum resid which contains less than about 10 wt. % material boiling between about 900° F. and 1040° F. (482.22° C. to 560° C.) as determined by High Temperature Simulated Distillation.

If the feedstock is one that does not form a free-flowing coke under coking conditions, one or more additives can be used in the feed to achieve that purpose. For example, one or more additives such as a soluble material, an organic insoluble material, or non-organic miscible additive (such as a metals-containing additive) can be introduced into the feedstock either prior to heating or just prior to conducting the feedstock into the coker vessel. In a preferred embodiment, the metal of the additive is at least one of potassium, sodium, iron, nickel, vanadium, tin, molybdenum, manganese, aluminum, cobalt, calcium, and magnesium. In yet another embodiment, the additive is selected from polymeric additives, low molecular weight aromatic compounds, and overbased surfactants/detergents.

Accordingly, the feedstock can be conducted (e.g., pumped) to a heater, or coker furnace, at a pressure of about 50 to about 550 psig (344.74 to 3792.12 kPa), where the feedstock is heated to a temperature ranging from about 900° F. (482.22° C.) to about 950° F. (510° C.). The heated resid is then conducted to a coking vessel, typically a vertically-oriented, insulated coker drum. The heated feedstock, combined with an additive if needed, is conducted into the coking vessel through one or more conduits located near the bottom of the drum. When two conduits are used, it is preferred that the conduits are positioned opposite of each other in the vessel.

In one embodiment, the bottom portion of the coker vessel is designed and fabricated to be directly sealed to the drum closure/discharge throttling system, whereas in another embodiment, particularly useful for retrofitting existing coker vessels, a bottom transition piece, herein termed a spool, is interposed between the vessel bottom and the drum closure/discharge throttling system and pressure-tightly sealed to both. In either of these two embodiments, a preferred feature is that the drum closure/discharge throttling system is pressure-tightly sealed to either (a) the coker vessel or (b) the spool piece. Preferably the pressure-tight seals will withstand pressures within the range of about 100 psi (689.48 kPa) to about 200 psi (1378.95 kPa), preferably within the range of about 125 psi (861.84 kPa) to about 175 psi (1206.58 kPa), and most preferably between about 130 psi (896.32 kPa) to about 160 psi (1103.16 kPa) and thereby preclude substantial leakage of the coker vessel contents including during operation thereof at temperature ranges between about 900° F. and about 1000° F. (482.22° C. to 537.78° C.). In embodiment (b) the spool piece preferably has a side aperture and flanged conduit to which the hydrocarbon feed line, or lines, is attached and sealed.

Figure 2:
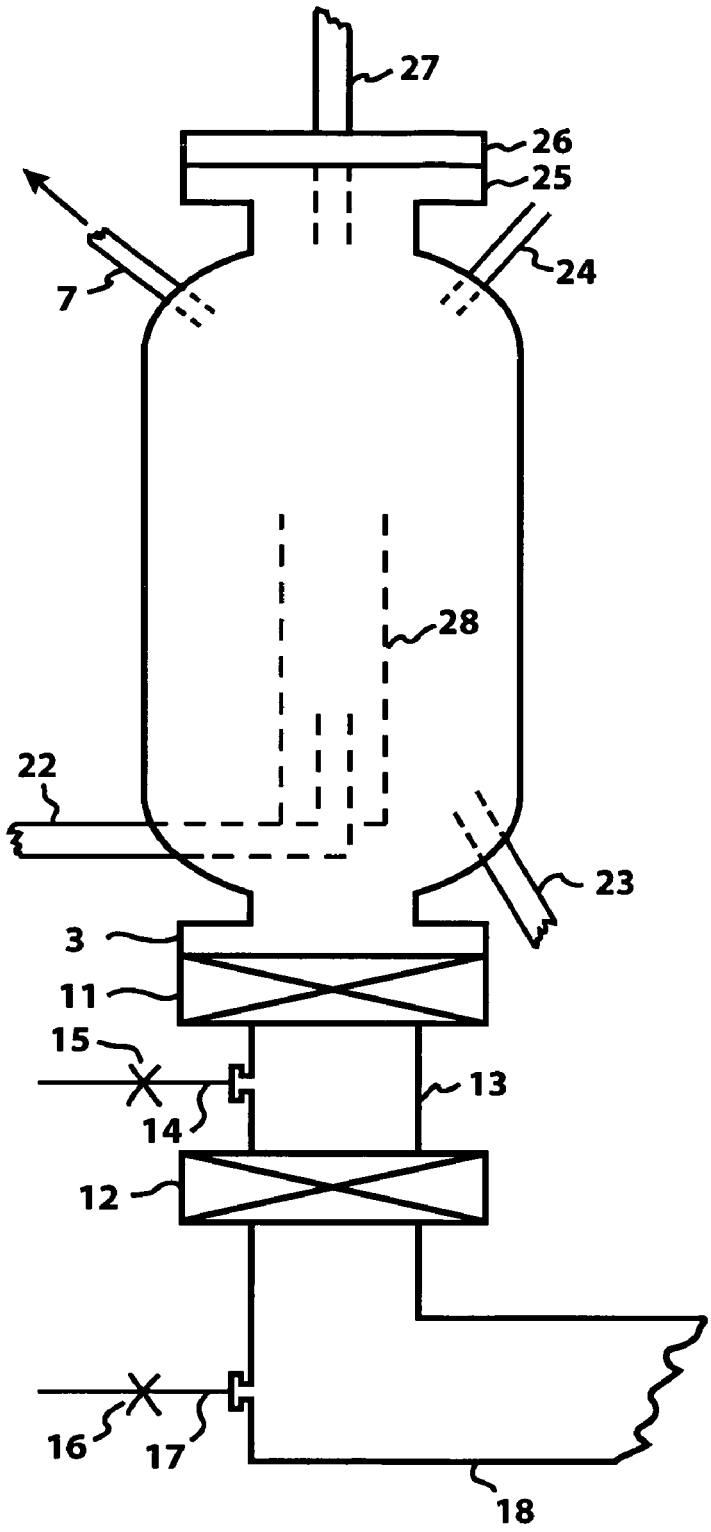
FIG. 2 is a schematic representation of another aspect of the process showing the continuous removal of coke using a lock hopper system.

In one embodiment, represented in FIG. 1 hereof, the coker vessel comprising a drum 1, that contains a bottom portion defining an aperture (not shown) through which coke is discharged. Feed is passed to vessel 1 via line 10 which enters a feed inlet system 2 which is comprised of one or more feed entry lines into the vessel at a position above the below bottom head 3. Feed inlet system 2 can be a single feed entry conduit (or "line") or a manifold with the appropriate pipe entry lines wherein the feed is divided and conducted through two or more feed entry lines. In an embodiment, two or more feed entry lines are used. In a related embodiment, two feed entry lines are used, each positioned above the drum closure/discharge throttling system, and each positioned about 180° from each other at the bottom of the yessel, i.e., opposite one another. Drum 1 is also provided with a port 4 at its top, which port contains a removable secured top head 5. While the port in conventional delayed coking allows for suitable high-pressure water jet equipment 6 to be lowered into the vessel to aid in the removal of the bed of coke that forms during delayed coking process, it is generally not needed in the continuous process since the coke is free-flowing. A vapor exit line 7 allows the removal of volatile components such as hydrocarbon vapors that are produced during the delayed coking process. Alternative feed injection embodiments are shown in FIG. 2. For example, in embodiments where coking times are relatively slow, feed can be injected near the upper part of the coker vessel via line 24 (which passes through the wall of the vessel) and/or line 27 (which passes through flange 26 attached to top head 25). When coking times are relatively fast, feed injection near the bottom of the vessel can be used, e.g., via lines 22 and/or 23. For intermediate coking times, a collar or conduit or channel 28 can be installed in the vessel, and feed can be injected via line 22 through the bottom of the channel upwards into the vessel with coke flowing downwards in the region between the outside of the channel and the vessel's inner wall.

Relatively slow coking times can result in the formation of an undesirable mesophase resulting from the slow drying of the coke in the vessel. For a particular feed under defined coking conditions, laboratory or bench-scale measurements can be used to observe whether mesophase formation occurs. If needed, adjustments can be made to feed and process conditions to avoid mesophase formation.

Where coking times are relatively slow, the mesophase can form because the coke does not dry fast enough, and this leads to the formation of undesirable sponge coke or transition coke. A minor amount of sponge coke and/or transition formation is acceptable, provided the coke mass in the vessel is free-flowing. In an embodiment, a resid feed has an hydrogen-to-carbon ("H/C") atomic ratio of about 1.4, and initial cracking kinetics of about 52 kcal/mol lessen the H/C ratio to about 0.7. The H/C ratio of about 0.7 is further lessened by thermal reactions, e.g., demethylation and dehydrogenation, which range from about 58 to about 66 kcal/mol, in order to provide an H/C ratio of about 0.5. A dry, free-flowing coke can be defined as a coke having a ("H/C") ratio of about 0.5. During this reduction in H/C ratio, the coke changes from sticky coke, due to the presence of a wet mesophase, to dry coke. High pressure, low temperature, and heavy oil recycle all act to prevent the evolution of volatiles from the coke at a fast enough rate which allow mesophase formation. Consequently, when coking times are relatively slow, zero recycle of heavy feed molecules, the lowest possible pressure, and the highest possible temperature are preferred since it is desirable to dry the mesophase as fast as possible so free-flowing shot coke is formed.

Relatively fast coking times can be identified (by e.g., laboratory and bench scale tests of the chosen feed and operating conditions) by the formation of free-flowing shot coke. A low recycle rate, higher temperature, and lower pressure all act to decrease coke drying time. Feed and process conditions selected for a fast coking time can be shifted toward an intermediate coking time by increasing recycle, lowering coking temperature, and raising coking pressure, which force the coke toward mesophase formation and slow drying of the mesophase, leading to sponge or transition coke formation.

One way to measure the time required to achieve a dry coke under coking conditions is by observing the results of a conventional open system pyrolysis mass spectrometry test. For example, conventional temperature programmed decomposition (TPD) (see, e.g., Kelemen, et al., *Fuel* 1993, 72, 645) can be used to quantify the evolution of $CH_4$ (mass 16) and higher hydrocarbon evolution from cracking reactions (typified by mass 41). The TPD evolution pattern can be made at a fixed heating rate (typically 0.23° C. per second), for example. Using a conventional kinetic model (from e.g., the Keleman reference) to analyze the TPD data, a constant pre-exponential of $13.2\times10^{13}$ $sec^{-1}$ can be used and the contribution of each first order kinetic process can be calculated at 2 kcal $mol^{-1}$ increments using all even activation energies. Cracking kinetics (at mass 41) representing the loss of $C_3^+$ side chains generally involve only 50, 52 and 54 kcal $mol^{-1}$ kinetic processes and do not yield a dry coke. The higher activation energy cracking kinetics $CH_4$ (mass 16) typically involve higher energy processes up to 70 kcal $mol^{-1}$. Dry coke is typically achieved following completion of greater than about 60 kcal $mol^{-1}$ $CH_4$ (mass 16) kinetic processes. By using the kinetics from cracking (mass 41) and from drying (greater than about 60 kcal $mol^{-1}$; $CH_4$ (mass 16)) for a specific feed, the times and temperatures needed to accomplish feed cracking and drying of the developing coke to an H/C atomic ratio of about 0.5 can be readily accomplished. If desired, the pre-exponential factor and the energy used for calculation of the distribution of 2 kcal $mol^{-1}$ increments can be further refined by conducting TPD experiments at different heating rates.

Figure 4:
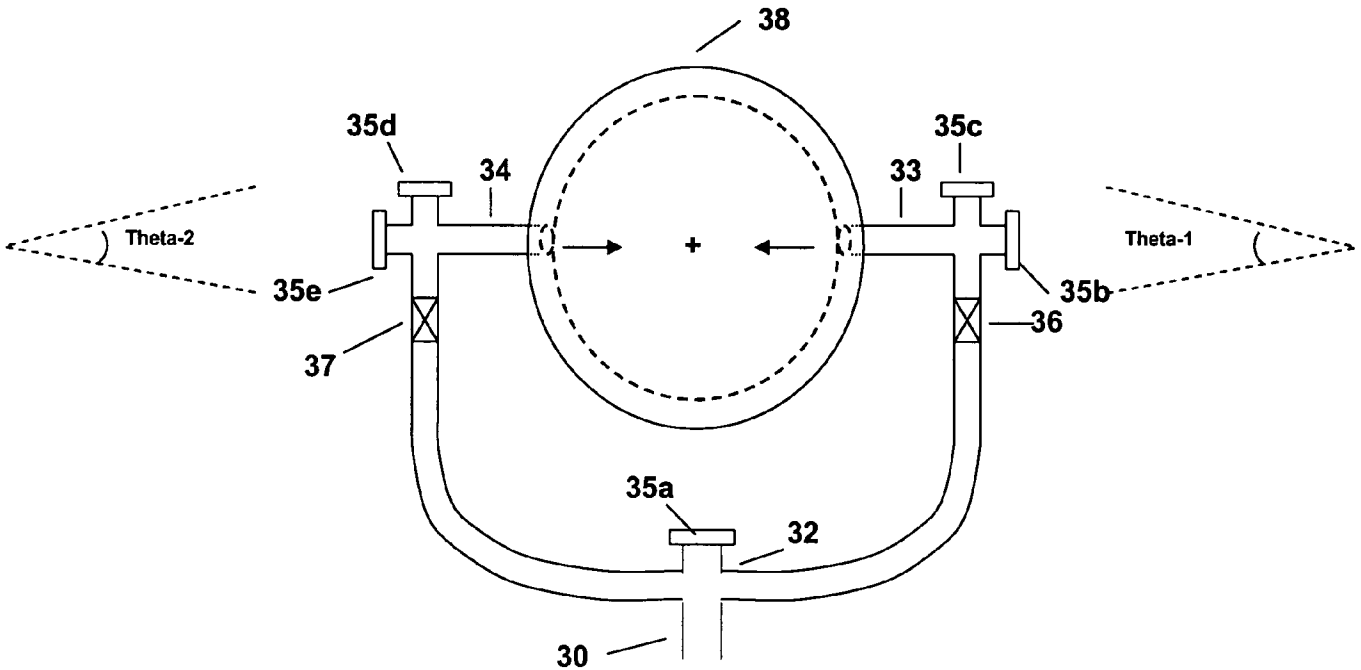
FIG. 4 is a schematic plan view of an alternative method for feed injection into the coking vessel.
Figure 5:
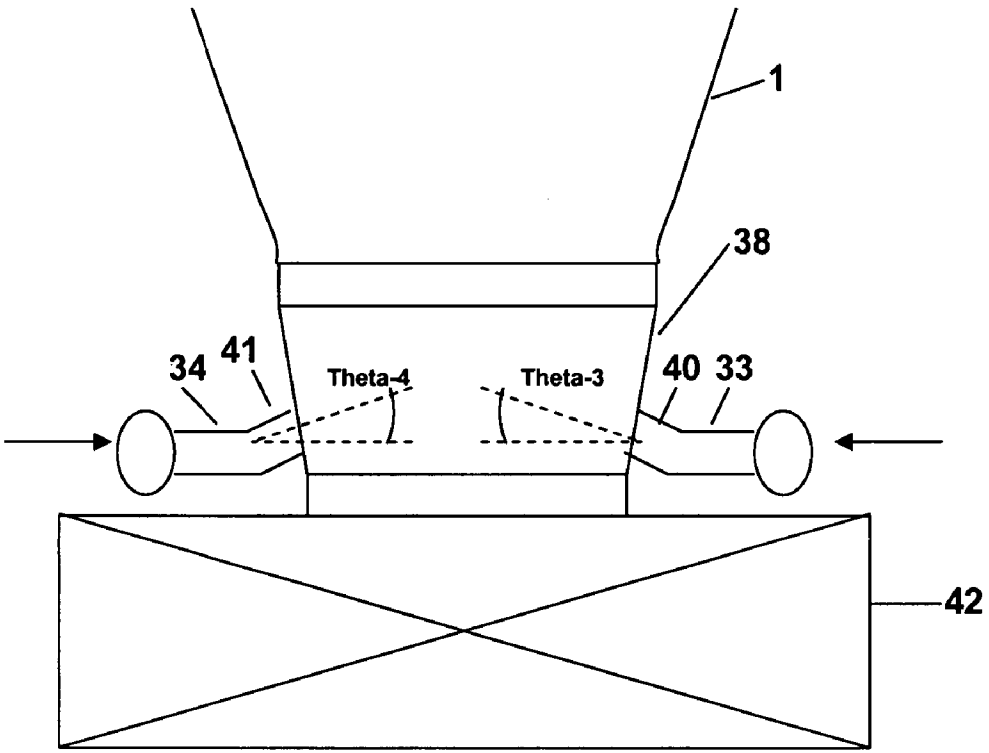
FIG. 5 is an elevation view of an alternative method for feed injection into the coking vessel.
Figure 6:
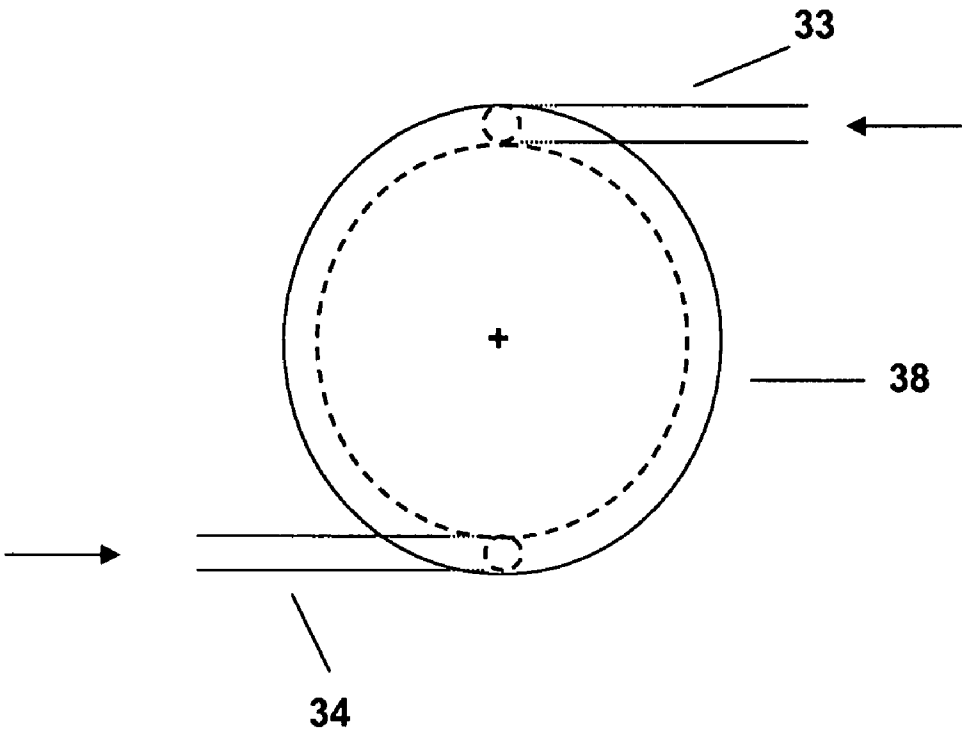
FIG. 6 illustrates the tangential introduction of feed into a coking vessel.

Additional feed injection alternatives are shown in FIGS. 4, 5, and 6. FIG. 4 is a horizontal cross-section schematic view (i.e., a "top view") of one embodiment illustrating a split and feed entrance into the coke drum.

Conduit 30 conducts heated feed to the coking process via, e.g., a coker feed switch valve (not shown). Conduit cross 32, with one port blocked, splits the feed and conducts the split feed via symmetrical conduits to entry conduits 33 and 34 located 180° apart on the bottom of the coke drum 1. Flanges 35*a-e* are blind flanges which serve as clean out ports. Optional block valves 36 and 37 can be used to facilitate clean out of the split feed lines. Conduits 33 and 34 conduct the feed into the coking vessel 1 through the lower coke drum inlet cone 38. While the center flow axes of inlet pipes 33 and 34 are shown normal to the coke drum cone (i.e., Theta-1 and Theta-2 are 0°). These pipes can be angled into the drum in both the horizontal and vertical planes. Theta-1 and Theta-2 represent angles that the feed pipes axes can span relative to a cone bisecting line a horizontal line, as shown in the figure. Theta-1 and/or Theta-2 can range up to about 30°.

FIG. 5 is an elevation cross-section schematic of the coke drum, inlet piping and bottom valve (i.e., a "side view"). The coke drum 1 is attached to the inlet transition spool piece or cone 38. Inlet conduits 33 and 34 conduct feed to the split feed inlet nozzles 40 and 41. A coke drum bottom unheading or throttling valve 42 is connected to cone 39. Theta-3 and Theta-4 represent the angles which the inlet nozzles make relative to the horizontal. In one embodiment, the angles Theta-3 and Theta-4 are equal to each other, and are between about 0° and about 45° above horizontal. In another embodiment, the angles Theta-3 and Theta-4 are equal to each other, and are between about 0° and about 15° above horizontal. In another embodiment, FIG. 6, the feed inlets are located tangentially, giving rise to a circular flow inlet pattern.

In an embodiment, the feed is conducted to a plurality of coking vessels from a coker furnace. The coker furnace usually has a number of parallel process fluid passes, and these are combined into feed transfer line. For each vessel, switching valve means are used to split the feed into at least one stream, preferably two streams, for example by a tee, wye, or cross with one port blocked off. A symmetrical split is preferred. In an embodiment, the feed splitter, downstream conduits (e.g., piping), and inlet apertures are configured such that the mass flow rate of one leg is within about 50% of the flow in the other leg, preferably within about 25% of the flow in the other leg.

The feed can comprise vapor, liquid, and optionally, coke. In an embodiment, the feed splitter, downstream piping, and inlet are configured such that the proportions of liquid to vapor in one leg is within 50% of that of the other leg, preferably within 25% of that of the other leg. Preferably the flow velocity in each leg of the split is approximately equal to or greater than the flow velocity in the combined furnace effluent line prior to the split.

While not wishing to be bound by any theory or model, it is believed that by uniformly splitting the feed, and directing the feed into the coker bottom inlet plenum via two nozzles opposed 180° apart, the feed flows impinge on one another, and do not impinge forcibly on the opposing wall, which results in a more uniform temperature distribution in the bottom plenum of the coke drum relative to a single feed inlet. Likewise, by uniformly splitting the feed, and directing the feed into the coker bottom inlet plenum via two nozzles arranged to create a tangential flow, a circular flow pattern is established, and this results in a more uniform temperature distribution in the bottom plenum of the coke drum relative to a single feed inlet. It is also believed that relative to a single horizontal feed inlet, this embodiment leads to a more uniform temperature distribution in the cone walls. This leads to less stress on the metal components in the vicinity of the feed inlet, reduced incidence of leaking flanges, and longer time between cracking of vessel walls.

In an embodiment, block valves or isolation valves are added to each of the split feed inlet lines. These reduce coke buildup in the feed conduits. During line steam-out, the pipe legs may be selectively isolated to ensure each leg is properly freed of resid. In an embodiment, feed enters the coking vessel via a spool piece that is added on to the bottom of an existing coke drum. Instrumentation can be added to the inlet lines, inlet nozzles, and section of coke drum/spool piece near the inlet nozzles, and this instrumentation along with process controllers may be used to control certain aspects of the coking cycle, e.g., water quench flow rate.

Turning again to FIG. 1, a drum closure/discharge throttling system is located below bottom head 3, and can be of any suitable design as long as it contains a closure member for closing off the aperture through which coke is discharged from the bottom of the vessel and as long as it can be throttled at a desired and controlled rate to allow the closure member to be controlled at a rate that will allow for the regulation of the amount of coke in the vessel and the safe discharge of substantially free-flowing coke. It is preferred that the drum closure/discharge throttling system meet one or more of the following criteria:

(i) It be of a mechanical design such that it can withstand the temperature cycling inherent in delayed coker operations without losing sealing integrity over years of operation.

(ii) Its mechanical design is such that it can withstand the static and dynamic pressure loads inherent in delayed coker operations without losing sealing integrity over years of operation.

(iii) The design of the closure member (valve) sealing system be such that the coke that is built up on the process side of the closure member surface during the coking operation can be cleanly sheared off during the valve opening.

(iv) When water is used in the process, the closure member components that are exposed to the coke plus water mixture be sufficiently robust to resist the erosive nature of the coke water mixture.

(v) The closure member mechanism be capable of controlled opening from the fully closed to fully open position.

(vi) Surfaces of construction materials that are exposed to the feedstock or to the reaction products should be resistant to such species as $H_2S$, $H_2$ and traces of HCl under specified temperature, pressure, and concentration ranges; and to traces of chloride ion in cutting and cooling water under specified conditions.

The drum closure/discharge throttling system can be any suitable valve system for such heavy duty use. Non-limiting examples include single-slide slide valves, dual-slide slide valves, ball valves, knife valves, wedge-within-wedge valves, ram valves, and wedge-plug valves.

The drum closure/discharge throttling system can be operated either manually or automatically. If the system is automatically operated, then it will be understood that the controller equipment can be located at a location remote from the coke vessel. By remote it is meant that it will still be located at the site where the coker vessel is located, but not on the coker process unit itself. The system can be automated by any conventional means. For example, one or more sensors can be located on the vessel to monitor temperature, pressure, coke level in the vessel, and coke discharge rate. It is preferred that at least one of the sensors be an acoustic sensor, especially the sensor that senses the level of coke in the vessel. When a predetermined threshold reading is obtained by the one or more sensors a signal, either wired or wireless, is sent to the controller equipment to open or close the closure member at a predetermined rate to reach the desired aperture size.

Coker vessel instrumentation can also be used to monitor coke morphology since the degree of looseness of a coke can be one of the factors in determining the rate of opening of the closure member. There can be a manual override of the automated system, e.g., for operation in case of an emergency. The controller equipment can be any suitable equipment, but will typically include a central processing unit and appropriate software.

One such valve currently available that meets these criteria is a valve manufactured by Zimmermann and Jansen Inc. and is described as a "double disc through conduit gate valve". Such a valve system is disclosed in U.S. Pat. No. 5,116,022. A single slide variant is disclosed U.S. Pat. No. 5,927,684. Also, U.S. Pat. No. 6,843,889 teaches the use of a throttling blind gate valve for discharging coke from a delayed coker. All three of these patents are incorporated herein by reference.

The closure member, which can be, e.g., a valve, is throttle controlled so that one will be able to release the coke from the coke drum at a controlled flow rate. While the actual aperture will be determined by the desired equilibrium amount of coke in the coking vessel, the valve is throttled at an effective rate of opening, which effective rate that will allow the discharge of coke at a rate of about 50 tons/hr to about 10000 tons/hr (50.8 Mg/hr to 10160.47 Mg/hr), preferred from about 100 tons/hr to about 5000 tons/hr (101.6 Mg/hr to 5080.24 Mg/hr), and more preferred from about 200 tons/hr to about 2000 tons/hr (203.21 Mg/hr to 2032.09 Mg/hr). In a preferred embodiment, coke is continuously withdrawn at a rate ranging from about 10 tons/hr to about 100 tons/hr. As discussed, the rate of coke production in equilibrium can depend on the choice of feed.

In an embodiment, the coke removal is advantageously carried out when the coke is a substantially free-flowing coke, preferably a substantially free-flowing shot coke. A free-flowing loose coke, or shot coke, product can be continuously withdrawn from the coker vessel through a quench system, eliminating the necessity of the drum switches used in conventional delayed coking. Alternatively, free-flowing coke can be withdrawn in a semi-batch operation via a staged lock hopper system for continuous coke removal.

In an embodiment illustrated in FIG. 2, the closure member, a spool piece, and a second closure member comprise a lock hopper system for continuous coke removal. As shown, the first closure member 11 is connected to the downstream (downstream with respect to coke flow) side of the vessel's bottom head 3, and the upstream end of spool piece 13 is attached to the downstream side of the first closure member. The second closure member 12 is attached to the downstream end of spool piece 13. In operation, the first closure member is at least partially opened to release coke from the vessel at a controlled rate. The second closure member is initially in the closed position. When the spool piece is filled with coke to the desired level, the first closure member is closed and the second closure member opened to release the coke. The first closure member is then opened or partially opened and the second closure member is closed to release coke into the spool piece at the desired rate. The process is then repeated for continuous (both valves partially pen) or semi-continuous operation. Feed admission rate, coke formation rate, and coke removal rate (lock hopper cycle time) are regulated so that a desired amount of coke remains in the drum. Valve means, comprising valves for regulating the rate of feed admission (not shown) and the first and second closure members, can be used to regulate coking conditions such as the feed admission rate, the amount of feed and coke in the drum, and the rate of coke removal from the drum. Valve means can further comprise valves (not shown) for regulating the amount and rate of hydrocarbon vapor withdrawn from the drum and valves 14 and 16 which can be used regulate the rate of coke removal.

The coke removed from the vessel can be hot and rich in volatile hydrocarbon, so that in optional downstream processing it can be desirable to prevent, e.g., ignition upon exposure to air. Consequently, in a related embodiment, a portion of the hydrocarbon vapor conducted away from the vessel via line 7 can be introduced into spool piece 13 via valve 15 and line 14 to strip the coke of volatile hydrocarbon. The vapor stream introduced via line 14 is also effective as a push gas for conducting coke in the spool piece through the second closure member. Optionally, the downstream side of the second closure member can be connected to conduit 18 so that the coke can be conducted away from the process. A second portion of hydrocarbon vapor from line 7 can be introduced into the conduit via valve 16 and line 17 to assist in coke transportation through the conduit.

Figure 3:
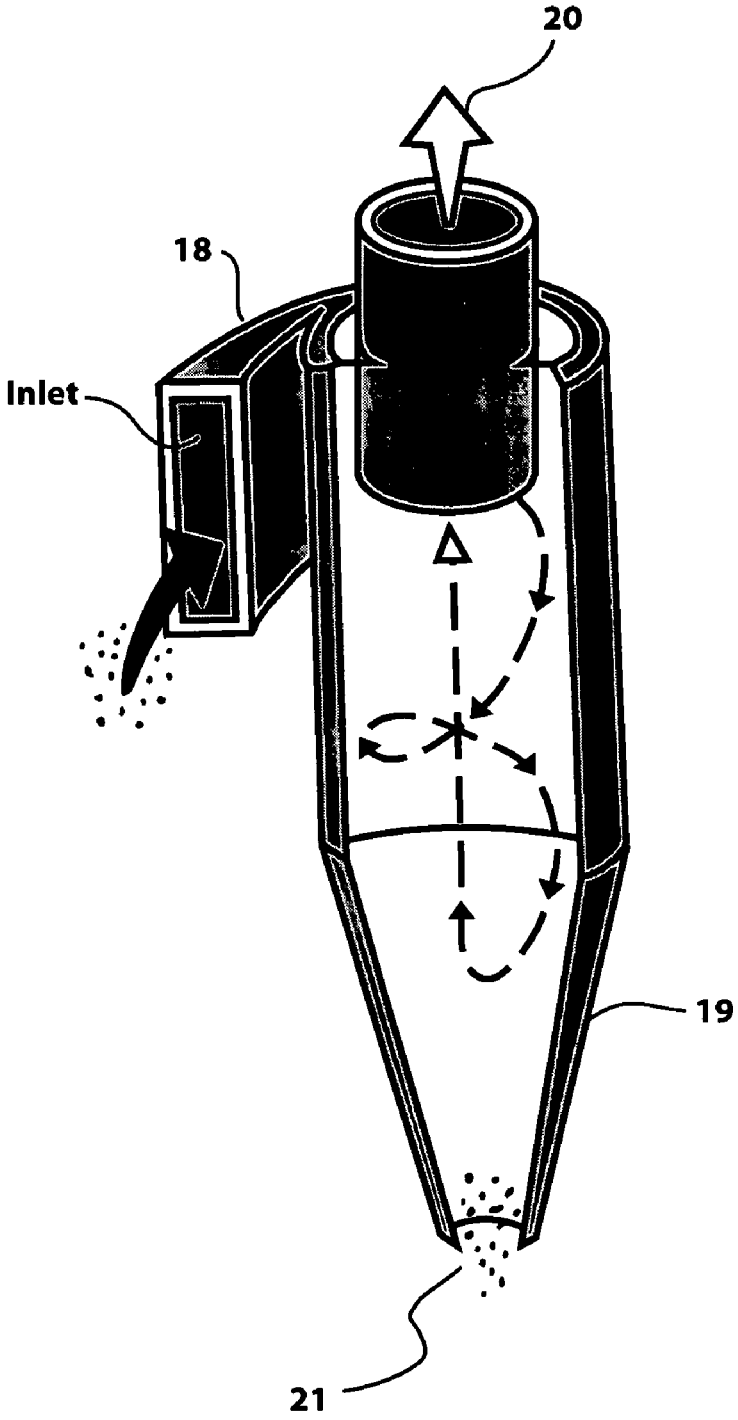
FIG. 3 is a schematic representation of a cyclone used to separate coke from vapor.

In an embodiment, coke in conduit 18 is disengaged from vapor. For example, conventional separation means such as a cyclone, preferably a transfer line cyclone, can be used to separate coke from vapor, as shown in FIG. 3. Referring to that figure, coke in conduit 18 is conducted to cyclone 19. One cyclone is shown though one or more can be used in parallel, series, or series parallel, preferably in parallel. Vapor having a diminished coke content is conducted away from the cyclone via outlet 20, and coke is conducted away from the cyclone via outlet 21. The coke can be further processed by, e.g., stripping (e.g., steam or hydrocarbon, particularly light hydrocarbons), water quench, and/or volume expansion to lower coke temperature. In another embodiment, the coke in conduit 18 can be conducted to a second vessel (also called a quench vessel) for expansion and, consequently, cooling. The second vessel can be a vessel converted from delayed coking service. Stripping of the cooled coke, if desired, can occur in the second vessel or in separate stripping equipment. Hydrocarbon recovered from stripping can be conducted away from the process. Alternatively, at least a portion of the hydrocarbon recovered from stripping can be (i) combined with hydrocarbon vapor recovered from the coker vessel via line 7, (ii) combined with coker feed, (iii) used in heat exchange equipment for feed pre-heat, or (iv) combinations thereof. As in conventional Fluid and FLEXICOKING processes, solids can be continuously withdrawn from the process by operating a closure member at the downstream end of the quench vessel. The closure member can be a conventional throttling slide valve, which provides a seal between the quench zone (pressure above ambient) and the coke handling system which is operated at approximately ambient (e.g., atmospheric) pressure.

Subject to the avoidance of combustion conditions in the removed coke, all or a portion of the push gas in lines 14 and 17 can be steam, nitrogen, or air; or mixtures of steam, nitrogen, and air. Water quench can be used for cooling. Steam and any hydrocarbon vapors obtained as a consequence of water quench can be conducted, for example, to delayed coker blow-down systems. Because the coke produced is a free-flowing coke, e.g., free-flowing shot coke, preferably a free-flowing shot coke, it can be conveyed by one or more of e.g., gravity; water; a vapor such as steam, air, hydrocarbon, and mixtures thereof; or conveyor transport such as a conveyor belt.

In another embodiment, the second closure member is omitted, and the position of the first closure member is regulated, together with feed admission rate and coking conditions, to achieve both the continuous removal of coke and the maintenance of an amount of coke in the vessel within a desired range.

In yet another embodiment, both the second closure member and the spool piece are omitted. In continuous operation, separation means, such as one or more cyclones, are used to separate coke so that it can be conducted away from the process.

Temperature and pressure in the coking vessel are regulated to provide for effective free-flowing coke formation.

Pressure in the drum will typically range from about 15 to about 80 psig (103.42 to 551.58 kPa) so that hydrocarbon vapors can be conducted away from the process. The temperature at the vapor outlet region in the upper portion of the vessel will range from about 780° F. to about 850° F. (415.56° C. to 454.44° C.), while the vessel feedstock inlet region will have a temperature of up to about 935° F. (501.67° C.). The hot feedstock thermally cracks over a period of time (the "coking time") in the coker drum, liberating volatiles composed primarily of hydrocarbon products that continuously rise through the coke mass and are collected overhead. Coking time depends on factors such as the feed selected and the coking conditions, but generally ranges from about one second to about 10 hours, preferably from about 0.5 hours to about 5 hours. The volatile products can be conducted to a coker fractionator (not shown) for distillation and recovery of various lighter products, including coker gases, gasoline, light gas oil, and heavy gas oil fractions. In one embodiment, a portion of one or more coker fractionator products, e.g., distillate or heavy gas oil may be captured for recycle and combined with the fresh feed (coker feed component), thereby forming the coker heater or coker furnace charge. In a preferred embodiment, coker pressure, temperature and steam addition are adjusted to increase the percentage of free-flowing coke in the coker drum preferably into the range of above about 50% of the coke volume in the vessel, more preferably above about 75%, and still more preferably above about 90%. Generally speaking, a higher temperature and a lower pressure lead to more effective removal of volatiles, and facilitates free-flowing shot coke formation. The recycle of heavy distillate is generally not needed.

Coke removal rate should be regulated so that there is sufficient feedstock residence time at coking temperature in the vessel to complete the coking of the individual particles (about one second to about 10 hours, preferably about 0.5 hours to about 5 hours). Some degree of staging and agitation can be employed in the vessel to improve coke flow-ability. In staging, coking reaction zones are configured in series to make coke. As opposed to a single reaction zone in the coker vessel (which can be stirred) where there is a distribution of residence times, staging completes the coking reaction in two or more reaction zones operated in series to ensure that all the material is given the required reaction time.

In the continuous process, the available drum volume can be regulated to provide a highly turbulent reaction zone, which favors free-flowing coke production, such as shot coke production. Increasing available drum volume also makes more of the vessel available for a foam layer, which also facilitates beneficial shot coke formation. With the drum volume available for the foam layer, anti-foam agents and procedures can be eliminated or dramatically reduced, providing an operational advantage over the conventional process. Since some anti-foam agents contain silica, which can undesirably affect downstream processing of the product vapor stream, the elimination of anti-foam use is beneficial.

There are generally three different types of solid delayed coker products that have different values, appearances and properties, i.e., needle coke, sponge coke, and shot coke. Needle coke is the highest quality of the three varieties. Needle coke, upon further thermal treatment, has high electrical conductivity (and a low co-efficient of thermal expansion) and is used in electric arc steel production. It is relatively low in sulfur and metals and is frequently produced from some of the higher quality coker feedstocks that include more aromatic feedstocks such as slurry and decant oils from catalytic crackers and thermal cracking tars. Typically, it is not formed by delayed coking of resid feeds.

Sponge coke, a lower quality coke, is most often formed in refineries. Low quality refinery coker feedstocks having significant amounts of asphaltenes, heteroatoms and metals produce this lower quality coke. If the sulfur and metals content is low enough, sponge coke can be used for the manufacture of electrodes for the aluminum industry. If the sulfur and metals content is too high, then the coke can be used as fuel. The name "sponge coke" comes from its porous, sponge-like appearance. Conventional delayed coking processes, using the preferred vacuum resid feedstock of the present invention, will typically produce sponge coke, which is produced as an agglomerated mass that needs an extensive removal process including drilling and water-jet technology. As discussed, this considerably complicates the process by increasing the cycle time.

There is also another coke, which is referred to as "transition coke" and refers to a coke having a morphology between that of sponge coke and shot coke or composed of mixture of shot coke bonded to sponge coke. For example, coke that has a mostly sponge-like physical appearance, but with evidence of small shot spheres beginning to form as discrete shapes.

Shot coke is considered the lowest quality coke. The term "shot coke" comes from its shape that is similar to that of BB sized [about 1/16 inch to 3/8 inch (0.16 cm to 0.95 cm)] balls. Shot coke, like the other types of coke, has a tendency to agglomerate, especially in admixture with sponge coke, into larger masses, sometimes larger than a foot in diameter. This can cause refinery equipment and processing problems. Shot coke is usually made from the lowest quality high resin-asphaltene feeds and makes a good high sulfur fuel source, particularly for use in cement kilns and steel manufacture.

Any suitable technique can be used to obtain coke that has a bulk morphology such that at least about 30 volume percent of substantially free-flowing under gravity and/or hydrostatic forces. Preferably, at least about 60 volume percent of the coke is substantially free-flowing, about 90 volume percent is more preferred, at least about 95 volume percent is most preferred. In an embodiment, substantially all of the coke is free-flowing coke.

One technique to form a free-flowing coke involves choosing a resid that has a propensity for forming shot coke; such feeds include Maya and Cold Lake. Another technique is to take a deeper cut of resid off of the vacuum pipestill. To make a resid that contains less than about 10 wt. % material boiling between about 900° F. (482.22° C.) and about 1040° F. (560° C.) as determined by High Temperature Simulated Distillation. Another preferred method for obtaining substantially free-flowing shot coke is the use a suitable additive. In an embodiment, the additive is an organic soluble or dispersible metal, such as a metal hydroxide, acetate, carbonate, cresylate, naphthenate or acetylacetonate, including mixtures thereof. Preferred metals are potassium, sodium, iron, nickel, vanadium, tin, molybdenum, manganese, aluminum, cobalt, calcium, magnesium and mixtures thereof. Additives in the form of species naturally present in refinery stream can be used. For such additives, the refinery stream may act as a solvent for the additive, which may assist in the dispersing the additive in the resid feed. Additives naturally present in refinery streams include nickel, vanadium, iron, sodium, and mixtures thereof naturally present in certain resid and resid fractions (i.e., certain feed streams). The contacting of the additive and the feed can be accomplished by blending a feed fraction containing additive species (including feed fractions that naturally contain such species) into the feed. Less metal additive is needed to convert a transition coke-forming feed to a shot coke-forming feed than for converting a sponge coke-forming feed to a shot coke forming feed. In addition, a metal additive such as calcium will be more effective on transition coke-forming feeds than on sponge coke-forming feeds.

In another embodiment, the metals-containing additive is a finely ground solid with a high surface area, a natural material of high surface area, or a fine particle/seed producing additive. Such high surface area materials include fumed silica and alumina, catalytic cracker fines, FLEXICOKER cyclone fines, magnesium sulfate, calcium sulfate, diatomaceous earth, clays, magnesium silicate, vanadium-containing fly ash and the like. The additives may be used either alone or in combination.

Alternatively, a caustic species is added to the resid coker feedstock. When used, the caustic species may be added before, during, or after heating in the coker furnace. Addition of caustic will reduce the Total Acid Number (TAN) of the resid coker feedstock by converting naphthenic acids to metal naphthenates, e.g., sodium, naphthenate.

Uniform dispersal of the additive into the vacuum resid feed is desirable to avoid heterogeneous areas of shot coke formation. Dispersing of the additive is accomplished by any number of ways, for example, by solubilization of the additive into the vacuum resid, or by reducing the viscosity of the vacuum resid prior to mixing in the additive, e.g., by heating, solvent addition, use of organometallic agents, etc. High energy mixing or use of static mixing devices may be employed to assist in dispersal of the additive agent.

Metals-free additives can also be used in the practice of the present invention to obtain a substantially free-flowing coke during delayed coking. Non-limiting examples of metals-free additives that can be used in the practice of the present invention include elemental sulfur, high surface area substantially metals-free solids, such as rice hulls, sugars, cellulose, ground coals ground auto tires. Additionally, inorganic oxides such as fumed silica and alumina and salts of oxides, such as ammonium silicate may be used as additives.

Overbased alkali and alkaline earth metal-containing detergents can also be employed as the additive of the present invention. These detergents are exemplified by oil-soluble or oil-dispersible basic salts of alkali and alkaline earth metals with one or more of the following acidic substances (or mixtures thereof): (1) sulfonic acids, (2) carboxylic acids, (3) salicylic acids, (4) alkylphenols, (5) sulfurized alkylphenols, (6) organic phosphorus acids characterized by at least one direct carbon-to-phosphorus linkage. Such organic phosphorus acids include those prepared by the treatment of an olefin polymer (e.g., polyisobutene having a molecular weight of 1000) with a phosphorizing agent such as phosphorus trichloride, phosphorus heptasulfide, phosphorus pentasulfide, phosphorus trichloride and sulfur, white phosphorus and a sulfur halide, or phosphorothioic chloride. The most commonly used salts of such acids are those of calcium and magnesium. The salts for use in this embodiment are preferably basic salts having a TBN of at least about 50, preferably above about 100, and most preferably above about 200. In this connection, TBN is determined in accordance with ASTM D-2896-88. Overbased alkali and alkaline-earth metal surfactants are disclosed in a co-pending application filed concurrently herewith under U.S. patent application Ser. No. 11/127,823, which is incorporated herein by reference.

Other suitable additives useful for encouraging the formation of substantially free-flowing coke include polymeric additives selected from the group consisting of polyoxyethylene, polyoxypropylene, polyoxyethylene-polyoxypropylene copolymer, ethylene diamine tetra alkoxylated alcohol of polyoxyethylene alcohol, ethylene diamine tetra alkoxylated alcohol of polyoxypropylene alcohol, ethylene diamine tetra alkoxylated alcohol of polyoxypropylene-polyoxyethylene alcohols and mixtures thereof. The polymeric additive will preferably have a molecular weight range of about 1000 to about 30,000, more preferably about 1000 to about 10,000. Such additives are disclosed in a co-pending application filed concurrently herewith under U.S. patent application Ser. No. 11/127,822, which is incorporated herein by reference.

The invention claimed is:

1. A continuous delayed coking process in which a plurality of delayed coker drums are operated continuously, comprising:

(a) heating a heavy hydrocarbon feed in a heater to a temperature of from about 900° F. to about 950° F. at a pressure of about 50 to 550 psig, (b) introducing the heated heavy hydrocarbon feed to a first delayed coker drum of the plurality of drums through at least one feed entry at a position above the bottom of the drum above an aperture at the bottom of the drum through which coke may be discharged from the drum;

(c) maintaining coking conditions in the first drum including a highly turbulent reaction zone at a pressure from about 15 to about 80 psig while continuing to add the feed through the feed entry for an effective amount of time in order to produce a hydrocarbon vapor and a coke product at least 90 percent of which is a substantially free-flowing shot coke product, the feed being introduced under coking conditions until a combination of feed and coke has partially filled the drum to an equilibrium level in which the amount of coke and feed in the drum is between about 10% and about 90% of the volume of the drum;

(d) continuously conducting the hydrocarbon vapor out of the first drum via a vapor outlet in the upper region of the drum and away from the process;

(e) withdrawing the coke product through the aperture and out of the first drum while regulating the rate of admission of the heated feed relative to the rate of coke removal to maintain an equilibrium level of the combination of coke and feed in the drum.

2. The process of claim 1, which further comprises conducting the shot coke product from the drum to a quench region, quenching the coke, and conducting the coke away from the quench region.

3. The process of claim 2, further comprising stripping the shot coke product.

4. The process of claim 3, wherein the stripping medium is at least one of (i) a portion of the hydrocarbon vapor, (ii) steam, (iii) a second hydrocarbon, and (v) combinations thereof.

5. The process of claim 1, wherein the coking conditions include a coking pressure ranging from about 15 to about 80 psig, a coking temperature ranging from about 780 to about 935° F. and a coking time ranging from about 10 seconds to about 5 hours.

6. The process of claim 5, wherein the temperature at the feed entry is in the range up to about 935° F.

7. The process of claim 1, wherein the feed to the coking process is heated in the heater and conducted from the heater to a plurality of coking drums including the first drum and at least a second drum, wherein the coking is conducted continuously in the first drum and continuously in a second drum of the plurality of drums by:

(g) introducing the heated heavy hydrocarbon feed to the second delayed coker drum through at least one feed entry at a position above the bottom of the second drum above an aperture at the bottom of the second drum through which coke may be discharged from the drum;

(h) maintaining coking conditions in the drum including a highly turbulent reaction zone at a pressure from about 15 to about 80 psig (103.42 to 551.58 kPa) while continuing to add the feed through the feed entry for an effective amount of time in order to produce a hydrocarbon vapor and a coke product at least 90 percent of which is a substantially free-flowing shot coke product, the feed being introduced under coking conditions until a combination of feed and coke has partially filled the drum to an equilibrium level in which the amount of coke and feed in the drum is between about 10% and about 90% of the volume of the drum;

(i) continuously conducting at least a portion of the hydrocarbon vapor out of the second drum via a vapor outlet in the upper region of the drum and away from the process;

(j) withdrawing the coke product through the aperture and out of the second drum while regulating the rate of admission of the heated feed relative to the rate of coke removal to maintain an equilibrium level of the combination of coke and feed in the drum.

8. The process of claim 7, in which a resid feed is conducted to a heater at a pressure of about 50 to 550 psig and heated to a temperature ranging from about 900° F. to about 950° F., the heated feed is conducted to the first and second coking drums and thermally converted in the drums under coking conditions including a coking pressure ranging from about 15 to about 80 psig, a coking temperature ranging from about 780 to about 935° F., and a coking time ranging from about 10 seconds to about 5 hours, while a hydrocarbon vapor is continuously conducted from the first and second drums away from the process.

9. A process according to claim 1 in which the coke product is conducted semi-continuously through the aperture and out of the drum while regulating the rate of admission of the heated feed relative to the rate of coke removal to maintain an equilibrium level of the combination of coke and feed in the drum by:

(i) opening a first closure member of a container at the bottom of the drum to release the coke into the drum through the aperture into the container while a second closure member is in the closed position, to fill the container with the coke to the desired level, (ii) releasing the coke from the container by closing the first closure member and opening the second closure member.

10. A process according to claim 9 in which, after the coke is released from the container, the second closure member is closed and the first closure member is opened to release coke into the container.

11. A process according to claim 9 in which the coke is the coke is withdrawn from the drum while it is hot and contains volatile hydrocarbon and is stripped of volatile hydrocarbon while in the container.

12. A process according to claim 1 in which the coke product is continuously withdrawn from the coker drum through the aperture.

13. The process of claim 12 in which the coke is continuously withdrawn from the first drum while it is hot and contains volatile hydrocarbon.

14. The process of claim 9 in which the coke is released into a plurality of containers.

15. The process of claim 7 in which the coke product is continuously withdrawn from the second coker drum through the aperture.

16. The process of claim 7 in which the hydrocarbon vapor is continuously conducted out of the second drum and away from the process and the coke product is conducted semi-continuously through the aperture and out of the second drum while regulating the rate of admission of the heated feed relative to the rate of coke removal to maintain an equilibrium level of the combination of coke and feed in the second drum by:

(i) opening a first closure member of a container at the bottom of the second drum to release the coke into through the aperture into the container while a second closure member is in the closed position, to fill the container with the coke to the desired level, (ii) releasing the coke from the container of the second drum by opening the second closure member.

17. The process of claim 16 in which the coke is released into a plurality of containers.

18. A process according to claim 16 in which, after the coke is released from the container of the second drum, the second closure member is closed and the first closure member is opened to release coke into the container.

19. A process according to claim 16 in which the coke is withdrawn from the second drum while it is hot and contains volatile hydrocarbon and is stripped of volatile hydrocarbon while in the container.

* * * * *